United States Patent [19]

Kumada et al.

[11] Patent Number: 4,768,057

[45] Date of Patent: Aug. 30, 1988

[54] FLASH FIXING APPARATUS

[75] Inventors: Toyohiko Kumada; Tatsuo Horiuchi, both of Tatebayashi, Japan

[73] Assignee: Ushio Denki Kabushiki Kaisha, Tokyo, Japan

[21] Appl. No.: 927,436

[22] Filed: Nov. 6, 1986

[30] Foreign Application Priority Data

Dec. 13, 1985 [JP] Japan ..... 60-191048[U]

[51] Int. Cl.[4] ..... G03G 15/00

[52] U.S. Cl. ..... 355/3 FU; 355/14 FU

[58] Field of Search ..... 355/3 FU, 14 FU

[56] References Cited

U.S. PATENT DOCUMENTS

| | | | |
|---|---|---|---|
| 3,861,863 | 1/1975 | Kudsi | 219/216 |
| 4,443,093 | 4/1984 | Yoshino et al. | 355/3 CH |
| 4,444,487 | 4/1984 | Miller et al. | 355/3 FU |
| 4,518,251 | 5/1985 | Larsson | 355/76 |

FOREIGN PATENT DOCUMENTS

| | | | |
|---|---|---|---|
| 0004842 | 1/1977 | Japan | 355/3 FU |
| 0025766 | 3/1981 | Japan | 355/14 FU |
| 0087573 | 5/1983 | Japan | 355/3 FU |

OTHER PUBLICATIONS

Fusing Apparatus, G. T. Williams, IBM Technical Disclosure Bulletin, Jul. 1969, pp. 272 and 273, vol. 12, No. 2.

*Primary Examiner*—Patrick R. Salce
*Assistant Examiner*—Judson H. Jones
*Attorney, Agent, or Firm*—Robert F. Ziems

[57] ABSTRACT

A flash fixing apparatus is provided for fixing an unfixed toner image on a base material by light radiated from a flash lamp. The apparatus includes a conveyor mechanism for conveying the base material, the flash lamp for radiating light toward the unfixed toner image on the base material which is being conveyed by the conveyor mechanism, and an auxiliary heating system for additionally heating the base material. The conveyor mechanism comprises a negative pressure compartment having an upper board, through which a plurality of suction holes are formed, and a plurality of conveyor belts arranged spacedly from one another in such a manner that the conveyor belts are caused to move over the upper board of the negative pressure compartment. The auxiliary heating system comprises at least one auxiliary heater disposed within the negative pressure compartment and adapted to heat the upper board of the negative pressure compartment.

12 Claims, 3 Drawing Sheets

FLASH FIXING APPARATUS

BACKGROUND OF THE INVENTION (1) Field of the Invention

This invention relates to a flash fixing apparatus for fixing an unfixed toner image, which has been formed on a base material by an electrophotographic printer, for example, by light radiated from a flash lamp.

(2) Description of the Prior Art

For example, an electrophotographic printer is usually equipped with an original document exposing unit, a developing unit, a transfer unit and a fixing unit. A toner image formed by development is usually transferred onto a base material, followed by its fixing by the fixing unit so as to form copied marks.

As fixing systems for such electrophotographic images, there have heretofore been known the gas-dependent fixing method, pressure-dependent fixing method, thermal fixing method, etc.

However, the gas-dependent fixing method is accompanied by problems that it requires a complex apparatus and is difficult to practice. In the pressure-dependent fixing method, a toner image is fixed by pressing the toner of the image directly while holding the toner image in contact, for example, with a roller. This method is therefore accompanied by a problem that certain distortion tends to occur in copied marks. On the other hand, the thermal fixing method is most widely employed where base materials are made of paper. This thermal fixing method is also accompanied by a drawback that some distortion tend to occur in copied marks, because heat is usually transmitted to a toner image so as to fix it while holding a fusing roller in contact with the toner image. The base material may be deformed, that is, may be caused to undergo so-called waving upon fixing, especially, where the base material is a plastic film having low heat resistance.

For the reasons described above, a fixing method making use of light from a flash lamp, namely, the flash fixing method has been finding more and more utility recently. According to this flash fixing method, it is possible to achieve prompt fixing without need for any warm-up time which is indispensable in the fixing method making use of fusing rollers. Further, a toner image on a base material can be fixed without bringing anything into contact with the toner image and the toner image can hence be fixed without lowering its resolution obtained by its development. As a further merit of the flash fixing method, it permits selective use of base materials having various different thicknesses. In this flash fixing method, light radiated from a flash lamp is absorbed by toner and is then converted to heat, thereby achieving the fixing of the toner. Since the radiation time of the light is extremely short, namely, 0.1—several milliseconds, it is possible to effect good fixing without causing thermal deformation (waving) even when the fixing is effected on a base material having relatively low heat resistance such as a plastic film.

When photocopies of maps, drawings which require long-term storage, or the like are made with toner, it is not recommendable to use paper sheets as base materials because such base materials are susceptible to expansion and shrinkage by moisture and the dimensional accuracy of the resultant fixed marks varies in accordance with the conditions of storage environment of the base materials and can hardly be maintained stably. For these reasons, special paper sheets with plastic or metallic core materials, each of which is resistant to expansion and shrinkage by moisture and is incorporated in the form of a sandwich, have been finding more and more utility.

When a photocopy is formed by toner, it may be desired in some instances to once discharge, in an unfixed state, a base material with a toner image transferred thereon from an electrophotographic printer without immediate fixing of the toner image. The unfixed toner image is then corrected as needed, and the thus-corrected toner image is fixed to obtain a final visible image. In order to meet such a demand, extensive research and development work is now under way with respect to flash fixing apparatus which are separate from electrophotographic printers and are employed exclusively for fixing purposes.

In such a flash fixing apparatus, conveyor means is required to convey each base material from its inlet part to its outlet part. Since the base material to be conveyed carries an unfixed toner image thereon, it is necessary to convey the base material smoothly without damaging the toner image. As conveyor means for such a base material, means which makes use of belts are simple and preferable. This belt-type conveyor means is however accompanied by a drawback that a base material is susceptible of curling along its edge areas and is hence bent or wrinkled especially when a base material in the form of a thin film is conveyed.

Since heating by light from a flash lamp is effected instantaneously, the base material may not be heated to any high temperature enough to cause the toner to adhere the base material with sufficient strength. This trouble occurs more frequently as the environmental temperature becomes lower, for example, as in winter.

If the energy of light from a flash lamp is increased, a contradictory phenomenon occurs that the toner is caused to scatter around at the moment of flashing and is not fixed sufficiently in contrast to the intention.

SUMMARY OF THE INVENTION

With the foregoing in view, the present invention has as its primary object the provision of a flash fixing apparatus designed exclusively for fixing purposes, which in spite of use of simple conveyor means making use of belts, can smoothly convey a base material on which toner is fixed even when the base material is in the form of a thin film and moreover, can fix the toner firmly on the base material by a simple construction without failure even when the environmental temperature is low.

In one aspect of this invention, there is thus provided a flash fixing apparatus for fixing an unfixed toner image on a base material by light radiated from a flash lamp. The apparatus comprises a conveyor mechanism for conveying the base material, the flash lamp for radiating light toward the unfixed toner image on the base material which is being conveyed by the conveyor mechanism, and an auxiliary heating system for additionally heating the base material. The conveyor mechanism comprises a negative pressure compartment having an upper board through which a plurality of suction holes are formed, and a plurality of conveyor belts arranged spacedly from one another in such a manner that the conveyor belts are caused to move over the upper board of the negative pressure compartment. The auxiliary heating system comprises at least one auxiliary heater disposed within the negative pressure compartment and adapted to heat the upper board of the negative pressure compartment.

Since the above flash fixing apparatus is provided with the negative pressure compartment having the upper board, through which the plurality of suction holes are formed, and the plurality of conveyor belts arranged to move over the upper board, the base material placed on the conveyor belts can be conveyed in a suitable position by the conveyor belts while being sucked though the suction holes against the upper board of the negative pressure compartment. The base material can hence be conveyed smoothly without being bent or wrinkled, even when the base material is in the form of a thin film. Further, the auxiliary heater which is adapted to heat the upper board of the negative pressure compartment is provided inside the negative pressure compartment. Therefore, the base material is additionally heated through the upper board when it is conveyed above the auxiliary heater. It is hence possible to adhere the toner firmly on the base material without failure by light from the flash lamp even when the environmental temperature is low.

BRIEF DESCRIPTION OF THE DRAWINGS

The above and other objects, features and advantages of the present invention will become apparent from the following description and the appended claims, taken in conjunction with the accompanying drawings, in which:

DETAILED DESCRIPTION OF THE INVENTION AND PREFERRED EMBODIMENT

Figure 1:
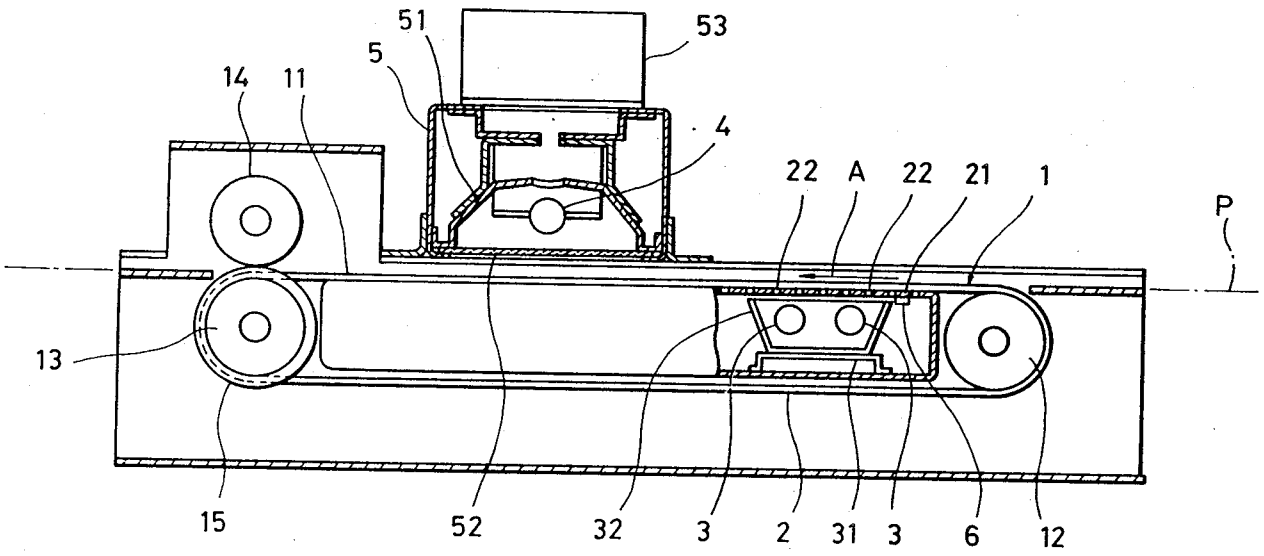
FIG. 1 is a simplified longitudinal cross-sectional front elevation of a flash fixing apparatus according to one embodiment of this invention.
Figure 2:
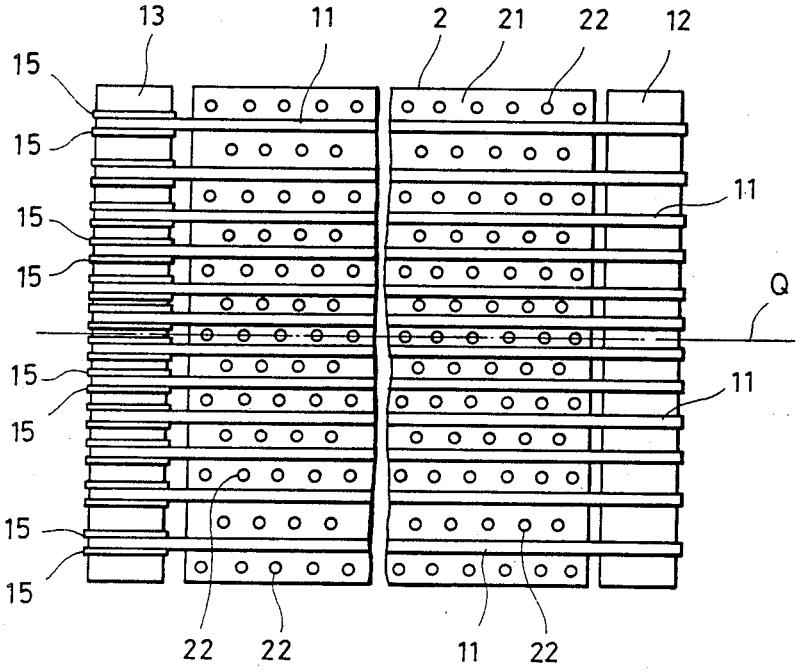
FIG. 2 is a frequency top plan view of the flash fixing apparatus.

The outline of the flash fixing apparatus according to one embodiment of this invention are shown in FIG. 1 and FIG. 2, in which numeral 1 indicates a conveyor mechanism. The conveyor mechanism 1 includes a negative pressure compartment 2 having an upper board 21 through which a plurality of suction holes 22 are formed, and a plurality of conveyor belts 11 arranged spacedly from one another in such a manner that the conveyor belts 11 are caused to move over the upper board 21 of the negative pressure compartment 2.

The conveyor belts 11 extend in a mutually-spaced state between an inlet roller 12 and an outlet roller 13. Upon rotation of these rollers 12,13, the conveyor belts 11 are caused to move along the upper board 21 of the negative pressure compartment 2. The outlet roller 13 is a drive motor which is driven by a motor (not shown), whereas the inlet roller 12 is a driven roller. Designated at numeral 14 is a discharge roller provided in combination with the outlet roller 13. On the outlet roller 13, there are provided ring members 15 such as O-rings which define the lateral positions of the side edges of the respective conveyor belts 11 for the prevention of their meandering and are, for example, made of a silicone resin or the like.

The conveyor belts 11 are each made of a material having excellent elasticity and heat resistance, for example, such as polyurethane and has a narrow, thin and planar configuration. Their thickness is for example about 1 mm or so while their width is about 10 mm or so. These conveyor belts 11 are arranged, for example, symmetrically relative to a center line Q of the path of conveyance. The distances between the adjacent conveyor belts 11 are chosen, for example, in such a way that they become greater as they become farther from the center line Q, whereby they can convey base materials ranging from that having a small size to that having a large size.

The suction holes 22 are formed at exposed areas of the upper board 21 of the negative pressure compartment 2, that is, areas other than those covered by the conveyor belts 11. The suction holes 22 are arranged along the path of conveyance of each base material, that is, from the inlet roller 12 to the outlet roller 13 at a suitable interval, for example, at an interval of about 30 mm in a zigzag pattern. The diameter of each of the suction holes 22 is, for example, about 3 mm or so.

The interior of the negative pressure compartment 2 is maintained under a reduced pressure by means of a suction mechanism (not shown) which may for example comprise a sirocco fan. The maximum air quantity of this sirocco fan may for example be 1,800–2,000 $cm^3$/min.

Designated at numeral 3,3 are auxiliary heaters. These auxiliary heaters 3,3 are spacedly arranged in the negative pressure compartment 2, for example, in such a way that they assume positions, which confront the lower surface of an upstream area of the upper board 21 of the negative compartment 2, and extend in the widthwise direction of the upper board 21 (i.e., in a direction perpendicular to the direction of conveyance of each base material). For example, the auxiliary heaters 3,3 are tubular halogen incandescent lamps. The length of their heating parts is substantially the same as the widthwise length of the upper board 21 of the negative pressure compartment 2. Both of these auxiliary heaters 3,3 are replaceably held on a holder 31. Numeral 32 indicates a reflector, which is cooled by air that flows in the negative pressure compartment 2.

Designated at numeral 4 is a flash lamp. This flash lamp 4 is for example a xenon flash lamp or the like. This flash lamp 4 is held by a holder 5 which is provided, for example, in opposition to a downstream area of the upper board 21. The holder 5 is composed of a lamp cover 51 surrounding the flash lamp 4 and including a reflective surface on the inner surface thereof, a transparent cover glass 52 provided over an opening formed in a lower part of the lamp cover 51, and an air-cooling fan unit 53 for cooling the flash lamp 4.

Designated at numeral 6 is a temperature sensor for detecting the temperature of the upper board 21. The temperature sensor 6 is fixed inside the negative pressure compartment 2, i.e, at a position on the lower surface of the upper board 21 where the temperature sensor 6 is not directly exposed to radiant heat from the auxiliary heaters 3,3.

The auxiliary heaters 3,3 are turned on and controlled by a control circuit (not shown in FIG. 1 and FIG. 2) of a feedback control system, which maintains the temperature of the upper board 21 at a constant level in accordance with temperatures to be detected by the temperature sensor 6.

Figure 3:
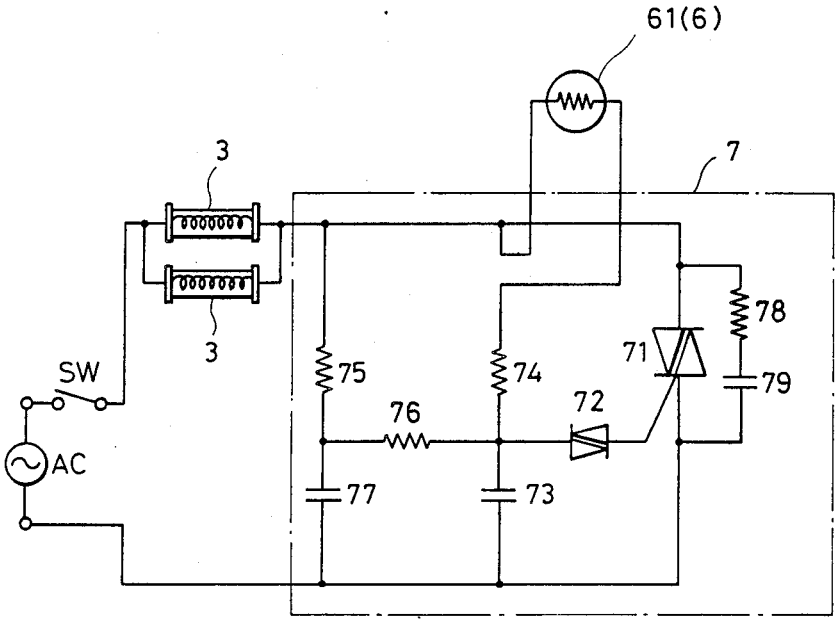
FIG. 3 is implified circuit diagram showing exemplary temperature sensor and control circuit.

One example of the control circuit 7 is shown in FIG. 3. In this example, the control circuit 7 uses a phase control system. As the temperature sensor 6, a positive thermistor 61 is used.

The control circuit 7 includes, basically, a triac 71 connected in series to the auxiliary heaters 3,3, a trigger diode 72 connected to the gate of the triac 71 and adapted to trigger the triac 71, a capacitor 73 for firing the trigger diode 72 whenever the breakover voltage is exceeded, and a resistor 74 for charging the capacitor 73. The positive thermistor 61 is connected at one end thereof to a resistor 74 and at the other end thereof to one of the terminals of the auxiliary heaters 3,3. Resistors 75,76 and capacitor 77 are elements for reducing the hysteresis, resistor 78 and capacitor 79 elements for absorbing surge voltages, SW a power supply switch, and AC a commercial AC power source.

When the positive half cycle of an a.c. power source AC is started while the power source switch SW is closed in the control circuit 7, the capacitor 73 is charged by the a.c. power source AC via the positive thermistor 61 and resistor 74. As soon as this charged voltage reaches the breakover voltage of the trigger diode 72, the trigger diode 72 is turned on so that the capacitor 73 discharges. By a trigger signal supplied to the gate of the triac 71 as a result of the above discharge, the triac 71 is turned on so that a current is fed to the auxiliary heaters 3,3 until the the polarity of the a.c. power source changes to negative. When the negative half cycle of the a.c. power source AC is started subsequently, the triac 71 is turned off and the supply of the current to the heaters 3,3 is terminated and at the same time, the capacitor 73 is charged again so as to control the conduction time of the capacitor 73 in the same manner as mentioned above. This operation is repeated every half cycle of the a.c. current source AC. The auxiliary heaters 3,3 are lit in the above-described manner. When the temperature of the upper board 21 becomes high and the temperature of the positive thermistor 61 increases, the resistance of the positive thermistor 61 also increases. Accordingly, it takes longer time until the capacitor 73 is charged to the breakover voltage of the trigger diode 72. As a consequence, it takes longer time until the triac 71 is turned on, whereby the lighting power consumption of the auxiliary heaters 3,3 decreases and less heat is hence given off. When the temperature of the upper board 21 becomes lower and the temperature of the positive thermistor 61 drops on the contrary, the resistance of the positive thermistor 61 becomes smaller and as a result, it takes shorter time until the capacitor 73 is charged to the breakover voltage of the trigger diode 72. In this case, the turn-on time of the triac 71 becomes earlier, the lighting power consumption of the auxiliary heaters 3,3 increases, and more heat is hence given off.

In accordance with the type of a toner and the type of a base material, the heating temperature of the upper board 21 is set at such a level that the fixing can be practically achieved to a sufficient degree. The parameters of the individual elements, which constitute the control circuit 7, are chosen to achieve the above temperature level.

In such a flash fixing apparatus which is intended exclusively for fixing purposes, a base material which has been discharged from the electrophotographic printer and carries an unfixed toner image on the surface thereof is conveyed by the conveyor belts 11 in a direction indicated by an arrow A (see, FIG. 1) while being sucked through the plurality of suction holes 22 against the upper board 21 of the negative pressure compartment 2. When the base material passes over the upstream area of the upper board 21 of the negative pressure compartment 2, the base material is additionally heated by the upper board 21 which is heated by the auxiliary heaters 3,3. During the period from the entry of the leading edge of the base material in the fixing area underneath the flash lamp 4 until the completion of passage of the trailing edge of the base material through the fixing area, the flash lamp 4 is caused to give off a flash of light repeatedly 4–18 times, for example, at a frequency of 2 Hz whenever the base material advances over a distance equivalent to the effective fixing width of the flash lamp 4, whereby the base material is subjected to fixing over the entire area thereof. The base material with the toner image fixed thereon is ejected to provide copied marks.

In the above-described embodiment, the negative pressure compartment 2 having the upper board 21, through which the plurality of suction holes 22 are formed, is provided and the plurality of conveyor belts 11 are provided extending between the inlet roller 12 and the outlet roller 13 in such a way that the conveyor belts 11 are allowed to move over the upper board 21 of the negative pressure compartment 2. Accordingly, the base material placed on the conveyor belts 11 are conveyed in a proper position by the conveyor belts 11 while being sucked through the plurality of suction holes 22 against the upper board 21 of the negative pressure compartment 2. Although the flash fixing apparatus of the above embodiment uses the simple conveyor means making use of the conveyor belts 11, a base material can be conveyed smoothly without being bent or wrinkled even when it is in the form of a thin film.

Further, the auxiliary heaters 3,3 are provided in the negative pressure compartment 2, on the upstream side of the area where each base material is exposed to light from the flash lamp 4, and at the locations facing the upper board 21. It is therefore possible to preheat the base material by the auxiliary heaters 3,3 without need for any additional space exclusively for the auxiliary heaters 3,3, in other words, while permitting the size reduction of the apparatus, when the base material passes over the upstream area of the upper board 21. Upon exposure to light from the flash lamp 4, the toner can be firmly fixed on the base material without failure even when the environmental temperature is low.

In the above embodiment, the auxiliary heaters 3,3 are lit and controlled by the control circuit 7 which performs feedback control on the basis of the temperature detected by the temperature sensor 6 provided on the upper board 21. Therefore, the upper board 21 is always maintained stably at a constant temperature. As a result, the base material is protected from overheating even when the environmental temperature is high as in summer, thereby avoiding bleeding of the toner or burning or scorching of the base material. Even when the environmental temperature is low as in winter, insufficient heating of the base material does not take place. Upon exposure to light from the flash lamp 4, it is hence possible to cause the toner to adhere firmly on the base material without failure irrespective of the environmental temperature.

In the above embodiment, the auxiliary heaters 3,3 are spacedly arranged in the negative pressure compartment 2 in such a way that they extend in the widthwise direction of the upper board 21 (i.e., in a direction perpendicular to the direction of conveyance of the base material) at the locations opposing the upstream area of the upper board 21 of the negative pressure compartment 2. Compared with the provision of a single piece of auxiliary heater, the heating area is wider and each base material can hence be heated sufficiently prior to its exposure to light.

Since halogen incandescent lamps are used as the auxiliary heaters 3,3, the upper board 21 can be promptly heated by radiant heat. It is therefore possible to perform a prompt fixing treatment without need for long warm-up time even when the environmental temperature is low.

The present invention has been described above on the basis of the one embodiment. The present invention is however not limited to the above-described embodiment and various embodiments may be contemplated as specified below by way of example.

(1) Only one auxiliary heater may be provided. Alternatively, two or more auxiliary heaters may be provided.

(2) The upper board may be additionally heated in its entirety by one or more auxiliary heaters. Namely, the upper board may also be additionally heated at the area where each base material is exposed to light from the flash lamp, so that the base material is additionally heated by the auxiliary heaters even while the base material is exposed to light from the flash lamp.

(3) No particular limitation is necessarily imposed on the specific constructions of the temperature sensor and control circuit. For example, the control circuit may be constructed by embodying an on-off control system or may take another construction.

Having now fully described the invention, it will be apparent to one of ordinary skill in the art that many changes and modifications can be made thereto without departing from the spirit or scope of the invention as set forth herein.

We claim:

1. A flash fixing apparatus for fixing an unfixed toner image on an upper surface of a base sheet comprising:

a flash lamp for radiating light toward said unfixed toner image as said base sheet is conveyed past said flash lamp;

a conveyor mechanism for conveying said base sheet past said flash lamp, said conveyor mechanism including a negative pressure compartment having an upper board containing a plurality of suction holes and a plurality of conveyor belts for moving said base sheet along the upper surface of said upper board;

an auxiliary heating system including at least one halogen incandescent lamp and a reflector for directing light radiated from said incandescent lamp toward said upper board to heat said upper board and thereby heat the lower surface of said base sheet to preheat said base sheet and improve the fixing of said toner image by said flash lamp; and, wherein said auxiliary heating system is located within said negative pressure compartment in order to provide for the preheating of said base sheet while maintaining the size of said flash fixing apparatus at a minimum.

2. The flash fixing apparatus as claimed in claim 1, whereing said auxiliary heating system is feedback controlled by the temperature of said upper board of said negative pressure compartment so as to maintain the temperature of said upper board at a constant level.

3. The flash fixing apparatus as claimed in claim 1, wherein said auxiliary heating system includes a plurality of halogen incandescent lamps.

4. The flash fixing apparatus as claimed in claim 2, wherein said auxiliary heating system includes a plurality of halogen incandescent lamps.

5. The flash fixing apparatus as claimed in claim 1, wherein said auxiliary heating system heats said upper board of said negative pressure compartment primarily at an area located on the side upstream of an area exposed to the light from said flash lamp.

6. The flash fixing apparatus as claimed in claim 2, wherein said auxiliary heating system heats said upper board of said negative pressure compartment primarily at an area located on the side upstream of an area exposed to the light from said flash lamp.

7. The flash fixing apparatus as claimed in claim 3, wherein said auxiliary heating system heats said upper board of said negative pressure compartment primarily at an area located on the side upstream of an area exposed to the light from said flash lamp.

8. The flash fixing apparatus as claimed in claim 4, wherein said auxiliary heating system heats said upper board of said negative pressure compartment primarily at an area located on the side upstream of an area exposed to the light from said flash lamp.

9. The flash fixing apparatus as claimed in claim 1, wherein said upper board includes a plurality of suction holes arranged in rows which extend in the direction of the conveyance and are located between adjacent conveyor belts.

10. The flash fixing apparatus as claimed in claim 9, wherein said conveyor belts are spaced from one another by progressively greater lateral distances proceeding from the longitudinal center of said negative pressure compartment, whereby said conveyor mechanism can convey base sheets of different widths.

11. A flash fixing apparatus for fixing an unfixed toner image on a base material by light radiated from a flash lamp, comprising:

a conveyor mechanism for conveying the base material, the flash lamp for radiating light toward the unfixed toner image on the base material which is being conveyed by the conveyor mechanism, and an auxiliary heating system for additionally heating the base material;

said conveyor mechanism comprising a negative pressure compartment having an upper board through which a plurality of suction holes are formed, and a plurality of conveyor belts arranged spacedly from one another in such a manner that the conveyor belts are caused to move over the upper board of the negative pressure compartment; and said auxiliary heating system comprising at least one auxiliary heater disposed within the negative pressure compartment and adapted to heat the upper board of the negative pressure compartment, wherein the auxiliary heater is feedback controlled by the temperature of the upper board of the negative pressure compartment so as to maintain the temperature of the upper board at a constant level, and wherein the feedback control of said auxiliary heater includes a control circuit having a triac connected in series to said auxiliary hearer, a trigger diode connected to the gate of the triac an adapted to trigger the triac, a capacitor for firing the trigger diode whenever the breakdown voltage is exceeded, a resistor for charging the capacitor and a positive thermistor having one end connected to the resistor and the other end connected to said auxiliary heater.

12. The flash fixing apparatus as claimed in claim 1, wherein said reflector is cooled by air that flows in said negative pressure compartment.

* * * * *

UNITED STATES PATENT AND TRADEMARK OFFICE

CERTIFICATE OF CORRECTION

PATENT NO. : 4,768,057

DATED : August 30, 1988

INVENTOR(S) : Toyohiko Kumada et al

It is certified that error appears in the above-identified patent and that said Letters Patent is hereby corrected as shown below:

Claim 2, line 2, change "whereing" to --wherein--.

Claim 9, line 4, delete "the".

Claim 11, line 28, change "hearer" to --heater--; and

Line 29, change "an" to --and--.

Signed and Sealed this

Seventh Day of February, 1989

*Attest:*

DONALD J. QUIGG

*Attesting Officer*

*Commissioner of Patents and Trademarks*